United States Patent [19]

Hembert

[11] Patent Number: 5,004,120

[45] Date of Patent: Apr. 2, 1991

[54] DEVICE TO PROTECT THE ENDS OF FLUID TANKS MADE OF COMPOSITE MATERIALS

[76] Inventor: Claude L. Hembert, Quartier les Maurels, 83400 Hyeres, France

[21] Appl. No.: 524,191

[22] Filed: May 16, 1990

[30] Foreign Application Priority Data

May 18, 1989 [FR] France ..... 89 06761

[51] Int. Cl.[5] ..... B65D 25/02

[52] U.S. Cl. ..... 220/414; 220/586

[58] Field of Search ..... 220/414, 3, 465, 459, 220/453

[56] References Cited

U.S. PATENT DOCUMENTS

| | | | |
|---|---|---|---|
| 3,057,509 | 10/1962 | Bernd | 220/414 |
| 3,137,405 | 6/1964 | Gorcey | 220/414 |
| 3,207,354 | 9/1965 | Skinner et al. | 220/414 |
| 3,409,201 | 11/1968 | Carpenter, Jr. | 220/414 |
| 4,765,507 | 8/1988 | Yavorsky et al. | 220/414 |

*Primary Examiner*—Joseph Man-Fu Moy

*Attorney, Agent, or Firm*—Browdy and Neimark

[57] ABSTRACT

A protective device, pertaining to tanks composed of an inside shell (3), an outside shell (4), and at least one metal end piece including a cylindrical joining piece (7) placed substantially in the longitudinal axis of the tank, comprises on each joining piece (7), a truncated protective metal collar (22) having the same conicity as the end piece of the joining piece and having an outside diameter at least equal to that of said end piece, the protective collar being solidary with a collet screwed on the outside part of the corresponding joining piece; and a washer (23) made of elastic material inserted between the protective collar and the outside surface of the end of the tank, and a pinch nut 24 screwed on the joining piece over the protective collar.

2 Claims, 1 Drawing Sheet

DEVICE TO PROTECT THE ENDS OF FLUID TANKS MADE OF COMPOSITE MATERIALS

FIELD OF THE INVENTION

The invention pertains to tanks for fluids of any type, such as gas at a pressure of approximately 10 to 500 bar, volatile or inflammable liquid, or hydraulic fluid.

It more specifically covers tanks made of composite materials, composed of a fluid impervious inside shell and made of molded synthetic materials, and an outside shell ensuring mechanical tolerance and made of resin reinforced with a filament winding. The ends of the tanks are reinforced mechanically by metal end pieces inserted between the two shells, and the metal end piece placed at the end of the tank which is normally open is endowed with a part in the form of a joining piece, equipped with a suitable means for connection to a source to supply fluid to the tanks or to control the outgoing fluid.

BACKGROUND OF INVENTION

Experience shows that, in the event of an impact on one of the end pieces, or in the event of excessive outside pressure on an end piece, as can occur with air tanks for deep-sea divers, the end piece can be driven into the tank, leading to the deterioration and even the rupture of the inside shell in the area around the periphery of the end piece. Such an accident allows the fluid to escape from the inside shell and move between the latter and the outside shell, which, because of its structure, can allow the pressurized fluid to escape to the outside.

SUMMARY OF INVENTION

An object of this invention is to correct the above noted problem by providing a protective device resistant to impacts and excessive outside pressure, which protective device is simple to use and inexpensive.

For this purpose, the device according to the invention comprises, on each joining piece of the tank, a truncated metal collar having the same conicity as the end piece of the joining piece and having an outside diameter at least equal to that of the end piece, such collar being solitary with a threaded collet screwed on a threading provided on the outside part of the joining piece, and further comprises a truncated washer made of elastic material inserted between the collar and the outside surface of the end of the tank, and furthermore, a pinch nut screwed on the joining piece.

Because of this arrangement, in the event the tank should fall on one of said ends, or in the event of an untimely impact or excessive outside pressure, the collar absorbs all of the stress and distributes it, by means of its entire surface, over both shells of the tank. This prevents any localization of the stress and opposes any rupture of the connection respectively between the inside and outside shells of the tank, and thus prevents any deterioration thereof. The washer made of elastic material absorbs the tightening moment on mounting, and, in the event of an impact, serves as an additional protective shock absorber for the tank. Finally, because of its metal structure, the protective collar also constitutes a support for marking any information concerning its structure, content or regulatory tests, by stamping.

BRIEF DESCRIPTION OF DRAWING

Other characteristics and advantages will emerge from the description below in reference to the sole figure of the attached schematic drawing showing a cross section of an embodiment of a tank endowed with a device according to the invention.

DETAILED DESCRIPTION OF PREFERRED EMBODIMENT

Figure 1:
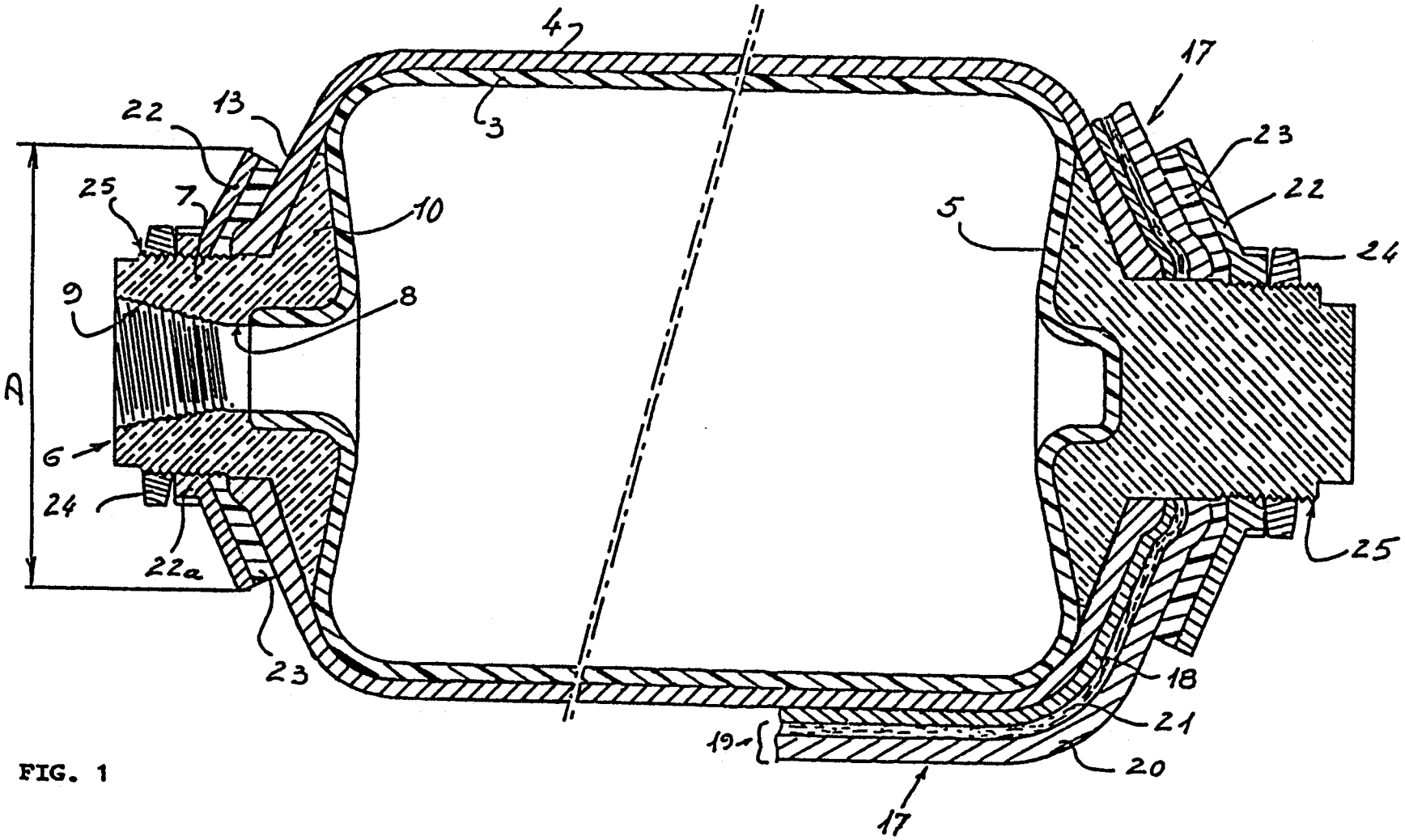

In a known manner, the tank, generally cylindrical in shape, comprises an inside shell 3 made for example of polyamide, polypropylene or polyethylene, and an outside shell 4 made, for example, of epoxy resin reinforced with filament wound fiber glass. The tank is equipped at its closed end with a joining piece having an end collar 5 located between the inside and outside shells 3 and 4, and made of a rigid material such as bronze, mechanical stainless steel, aluminum alloy or stainless steel.

At its open end, the tank is equipped with an end piece 6 made of the same material as the closed end piece including the collar 5, and comprising a tubular part 7 forming a neck. The central bore 8 of the open end piece 6 is threaded at 9 to allow the connection of a tubular, pressure reducing valve or tap. The end piece 6 also comprises a collar 10 which, like collar 5, is endowed with an outside surface 13 which, designed to come into contact with the interior surface of the outside shell 4, is truncated.

As shown at the right side of the figure, such a tank can also comprise a protective covering 17 to provide thermal and fire protection, composed of two layers, namely an inside layer 18 composed for example of a sheet of ceramic fiber paper, and an outside layer 19 composed of a mechanically-assembled glass fabric 20 - glass mat 21 fire-proofing complex.

According to the invention, each end of the tank is reinforced with means placed on each of its joining end pieces and comprising a protective metal collar 22, a washer 23 made of elastic material and a pinch nut 24. The protective metal collar 22 is solitary, such as by being made integral, with a collet **22*a* threaded on the inside and screwing on a threading 25 provided on the outside of the axial tenon of the corresponding joining piece. The protective collar 22 is truncated and has the same conicity as support surface 13 of the joining and piece 6. The protective collar 22 has an outside diameter D at least equal to the outside diameter of its corresponding joining end piece, e.g. end piece 6. Washer 23 is truncated and made of rubber or any other elastic and compressible material. The washer 23 absorbs the tightening moment of the protective collar 22, and also absorbs most of the shocks and stress applied to protective collar 22 thus protecting the outside shell 4 of the tank. A pinch nut holds collar 22** perfectly in place, preventing it from unscrewing.

Because of this arrangement, if the tank falls on one of its ends, the protective collar 22 absorbs all of the stress from the impact, distributes it over the tank because of its large support surface and thus prevents any breaking of the connection of outside shell 4 with inside shell 3 and of inside shell 3 with the corresponding end piece. In other words, the protective collar prevents any deterioration of the tank, either as the result of an impact or in the event of excessive external pressure.

The right side of the figure shows that the protective collar can also be placed over the fire-proofing covering to perform the same protective functions. Finally, due to its large rigid surface, the protective collar also constitutes a support for marking any information concerning the tank, its contents or its certification tests, by stamping or another process.

The foregoing description of the specific embodiments will so fully reveal the general nature of the invention that others can, by applying current knowledge, readily modify and/or adapt for various applications such specific embodiments without departing from the generic concept, and therefore such adaptations and modifications are intended to be comprehended within the meaning and range of equivalents of the disclosed embodiments. It is to be understood that the phraseology or terminology herein is for the purpose of description and not of limitation.

What is claimed is:

1. A tank for containing fluid under pressure, comprising:

an inside shell 3 for ensuring imperviousness to the pressurized fluid and made of molded synthetic material; an outside shell 4, concentric with said inside shell, ensuring mechanical tolerance and made of resin reinforced by a filament winding; and at least one metal end piece having an annular collar with a frustoconical surface between said shells reinforcing at least the end of the tank endowed with an opening, with bonding between the ends of the two shells; and wherein said metal end piece further comprises a cylindrical portion coaxial with the longitudinal axis of the tank; and a truncated protective metal collar 22 having the same conicity as said frustoconical surface of the annular collar of the joining piece and having an outside diameter at least equal to that of said annular collar, said protective collar being solitary with a collet 22*a* screwed on a threading 25 provided on the outside part of said cylindrical portion; a washer 23, made of elastic material inserted between the protective collar 22 and the outside surface of the end of the tank, and a pinch nut 24 screwed on said cylindrical portion over said protective collar 22.

2. A tank according to claim 1, further comprising protective covering over said outside shell, said washer 23 abutting an outside surface of said protective covering.

* * * * *